US008342895B2

(12) United States Patent
Yoshida et al.

(10) Patent No.: US 8,342,895 B2
(45) Date of Patent: Jan. 1, 2013

(54) CONNECTOR AND METALLIC MATERIAL FOR CONNECTOR

(75) Inventors: Kazuo Yoshida, Tokyo (JP); Kyota Susai, Tokyo (JP); Takeo Uno, Tokyo (JP); Shuichi Kitagawa, Tokyo (JP)

(73) Assignee: Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 12/595,057

(22) PCT Filed: Mar. 31, 2008

(86) PCT No.: PCT/JP2008/056414

§ 371 (c)(1), (2), (4) Date: Mar. 25, 2010

(87) PCT Pub. No.: WO2008/126719

PCT Pub. Date: Oct. 23, 2008

(65) Prior Publication Data

US 2010/0190390 A1 Jul. 29, 2010

(30) Foreign Application Priority Data

Apr. 9, 2007 (JP) ..... 2007-102099

(51) Int. Cl.
*H01R 9/24* (2006.01)
*H01R 13/02* (2006.01)

(52) U.S. Cl. ..... 439/886; 439/887

(58) Field of Classification Search ..... 439/886
See application file for complete search history.

(56) References Cited

U.S. PATENT DOCUMENTS

| | | | | |
|---|---|---|---|---|
| 5,849,424 | A * | 12/1998 | Sugawara et al. | 428/674 |
| 5,967,860 | A * | 10/1999 | Ricketts et al. | 439/886 |
| 6,183,885 | B1 * | 2/2001 | Nakamura et al. | 428/647 |
| 6,537,091 | B2 * | 3/2003 | Hirai et al. | 439/181 |
| 6,770,383 | B2 * | 8/2004 | Tanaka et al. | 428/646 |
| 7,029,760 | B2 * | 4/2006 | Mori et al. | 428/600 |
| 7,357,681 | B2 * | 4/2008 | Yamagami et al. | 439/886 |
| 7,824,776 | B2 * | 11/2010 | Yoshida et al. | 428/647 |
| 2003/0186597 | A1 * | 10/2003 | Suzuki et al. | 439/886 |
| 2009/0061253 | A1 * | 3/2009 | Yoshida et al. | 428/632 |
| 2010/0304177 | A1 * | 12/2010 | Yoshida et al. | 428/610 |
| 2011/0009015 | A1 * | 1/2011 | Yoshida et al. | 439/886 |

FOREIGN PATENT DOCUMENTS

| | | | |
|---|---|---|---|
| JP | 10-302867 | A | 11/1998 |
| JP | 2000-21545 | A | 1/2000 |
| JP | 2000-212720 | A | 8/2000 |
| JP | 2000-226645 | A | 8/2000 |
| JP | 2003-082499 | A | 3/2003 |
| JP | 2003-213486 | A | 7/2003 |
| JP | 2004-68026 | A | 3/2004 |
| JP | 2004-179055 | A | 6/2004 |
| JP | 2004-339555 | A | 12/2004 |
| JP | 2006-114492 | A | 4/2006 |
| JP | 2006-324063 | A | 11/2006 |

* cited by examiner

*Primary Examiner* — Hae Moon Hyeon
(74) *Attorney, Agent, or Firm* — Kubotera & Associates, LLC

(57) ABSTRACT

A connector includes a male terminal and a female terminal. At least one of the male terminal and the female terminal has an outermost surface layer formed of a metallic material as an alloy layer of Cu—Sn. The alloy layer of Cu—Sn has a concentration of Cu decreasing gradually toward a surface thereof. The metallic material for the connector includes the outermost surface layer formed of the alloy layer of Cu—Sn. The alloy layer of Cu—Sn has the concentration of Cu decreasing gradually toward the surface thereof.

3 Claims, 8 Drawing Sheets

CONNECTOR AND METALLIC MATERIAL FOR CONNECTOR

CROSS-REFERENCE TO RELATED APPLICATIONS

This application is U.S national stage of PCT Application No. PCT/JP2008/056414, filed on Mar. 31, 2008, which claims priority to Japanese Patent Application No. 2007-102099, filed on Apr. 9, 2007.

TECHNICAL FIELD

The present invention relates to a connector having a male terminal and a female terminal, and a metallic material to be used for the connector.

BACKGROUND ART

In general, a connector for connecting an electric wire in a motor vehicle or the like is provided with a male terminal and a female terminal, in which a metal covering layer formed of tin (Sn), an alloy of tin, or the like is disposed on an electrically conductive substrate (referred to as a substrate properly hereinafter) formed of an alloy of copper (Cu) or the like. The male terminal and the female terminal are individually housed in a housing, and are configured as a male connector and a female connector, respectively. The male terminal and the female terminal are formed of a metallic material, in which the metal covering layer formed of Sn or the alloy of Sn is formed on the electrically conductive substrate formed of Cu or the alloy of Cu through plating or the like. The metallic material is known as a high performance electric conductor with a combination of superior electrical conductivity and strength of the substrate and superior electrical connectability, corrosion resistance, and solderability of the metal covering layer (refer to Patent Documents 1 to 4 for example). The metallic material in general has an underlayer formed of nickel (Ni), cobalt (Co), iron (Fe) or the like through plating or the like with a barrier function for preventing an alloy content of zinc (Zn) of the substrate (refer to as a substrate element hereinafter) from diffusing into the metal covering layer.

In an environment of a high temperature such as an inside of an engine room of a motor vehicle or the like, an oxide film layer tends to be formed on a surface of the metal covering layer of Sn or the like on a surface of the terminal as Sn is easy to be oxidized. When the terminal is connected, the oxide film layer tends to be broken due to brittleness thereof. Accordingly, non-oxidized Sn under the metal covering layer is exposed, thereby obtaining excellent electrical connectability.

In recent years, the connector becomes a multi way type as an electronic control thereof progresses. Accordingly, it is necessary to insert or pull out a group of terminals of a male connector to or from those of a female connector with a large force. In a small space such as an inside of an engine room of a motor vehicle or the like, in particular, it is required to decrease the force for inserting and extracting due to difficulty of working.

In order to reduce the force for inserting and extracting, there is provided a method of reducing a pressure of a contact between the terminals. However, in a case where the method is adopted, a fretting phenomenon may occur between contact faces of the terminals, thereby causing a failure in electrical conduction between the terminals.

In the fretting phenomenon, the contact surfaces of the terminals slightly slide against each other due to a vibration or a variation in a temperature. Accordingly, the plating layer of Sn as a soft layer on the surface of the terminal is worn away and oxidized, thereby generating an abrasion powder with a large specific resistance. When the fretting phenomenon occurs between the terminals, connection of the terminals may be deteriorated. When a contact pressure between the terminals decreases, the phenomenon tends to occur more easily. When a thickness of the plating layer of Sn on the surface of the terminal of the connector decreases, it is possible to prevent the phenomenon somehow. However, it is still difficult to completely prevent the phenomenon.

In order to prevent the fretting phenomenon, an intermetallic compound layer of Cu—Sn such as $Cu_6Sn_5$ or the like may be formed on a base material as a hard layer (refer to Patent Document 5 and 6). However, in the method, a large amount of an element of the base material such as Cu or the like diffuses into the intermetallic compound layer of Cu—Sn, thereby making the intermetallic compound layer brittle.

Still further, there is disclosed a metallic material in which a layer of Ni is provided between the substrate and the intermetallic compound layer of Cu—Sn in order to prevent diffusion of an element from the substrate (refer to Patent Document 7). In the metallic material, no layer of Sn or Cu exists between the layer of Ni and the intermetallic compound layer of Cu—Sn. When the metallic material is produced, Ni, Cu and Sn are sequentially plated on the substrate as a layered structure, and then thermally treated. Accordingly, it is necessary to exactly design a thickness of the plating of the layered structure based on a stoichiometric proportion of Cu and Sn, and to perform the heat treatment under a strict control, thereby requiring extensive production efforts.

Furthermore, there is proposed a structure in which an intermetallic compound layer of Cu—Sn such as a $Cu_6Sn_5$ or the like is formed on a base material as a hard layer, and a particle of Sn is attached to a part of a surface of the intermetallic compound layer (refer to Patent Document 8). However, Sn is formed in a soft particle, and the fretting phenomenon still occurs between the contact faces of the terminals, thereby providing no advantage over Patent Documents 1 to 4.

[Patent Document 1] Japanese Patent Application Publication No. 2004-179055

[Patent Document 2] Japanese Patent Application Publication No. 2000-021545

[Patent Document 3] Japanese Patent Application Publication No. 2003-082499

[Patent Document 4] Japanese Patent Application Publication No. 2004-339555

[Patent Document 5] Japanese Patent Application Publication No. 2000-212720

[Patent Document 6] Japanese Patent Application Publication No. 2000-226645

[Patent Document 7] Japanese Patent Application Publication No. 2004-068026

[Patent Document 8] Japanese Patent Application Publication No. 2003-213486

DISCLOSURE OF THE INVENTION

According to the present invention, the following aspects are provided.

1. According to a first aspect of the present invention, a connector comprises a male connector including a male terminal; and a female connector including a female terminal and arranged to be connectable with the male connector. At least one of the male terminal and the female terminal has an outermost surface layer formed of a metallic material as an alloy layer of Cu—Sn.

2. According to a second aspect of the present invention, connector comprises a male connector including a male terminal; and a female connector including a female terminal and arranged to be connectable with the male connector. At least one of the male terminal and the female terminal has a contact member part with an outermost surface layer formed of a metallic material as an alloy layer of Cu—Sn.
3. According to a third aspect of the present invention, a connector comprises a male connector including a male terminal; and a female connector including a female terminal and arranged to be connectable with the male connector. At least one of the male terminal and the female terminal has an outermost surface layer formed of a metallic material as an alloy layer of Cu—Sn. The other of the male terminal and the female terminal has a contact member part with an outermost surface layer formed of a metallic material as a layer of Sn or an alloy layer of Sn.
4. According to a fourth aspect of the present invention, a metallic material for a connector to be used for the connector in one of the aspects 1 to 3 comprises the outermost surface layer formed of the alloy layer of Cu—Sn.
5. According to a fifth aspect of the present invention, in the metallic material in the aspect 4, the alloy layer of Cu—Sn has a concentration of Cu decreasing gradually toward a surface thereof.
6. According to a sixth aspect of the present invention, in the metallic material in the aspect 4 or 5, the alloy layer of Cu—Sn includes Sn or an alloy of Sn diffused therein.
7. According to a seventh aspect of the present invention, in the metallic material in the aspect 6, at least a part of Sn or the alloy of Sn is exposed on a surface of the alloy layer of Cu—Sn, Sn or said alloy of Sn being diffused in an island shape or a punctuate shape in a cross sectional view.
8. According to an eighth aspect of the present invention, in the metallic material in the aspect 4, the alloy layer of Cu—Sn is arranged on an electrically conductive substrate.
9. According to a ninth aspect of the present invention, the metallic material in the aspect 4 further comprises a metal layer disposed between the electrically conductive substrate and the alloy layer of Cu—Sn. The metal layer is formed of Cu, an alloy of Cu, Ni, an alloy of Ni, Fe, an alloy of Fe, Co, or an alloy of Co.
10. According to a tenth aspect of the present invention, the metallic material in the aspect 4 further comprises more than two types of metal layers disposed between the electrically conductive substrate and the alloy layer of Cu—Sn. The metal layers are formed of Cu, an alloy of Cu, Ni, an alloy of Ni, Fe, an alloy of Fe, Co, or an alloy of Co.
11. According to an eleventh aspect of the present invention, in the metallic material in one of the aspects 4 to 10, the alloy layer of Cu—Sn is formed through thermal diffusion between a plating layer of Cu or an alloy of Cu and a plating layer of Sn or an alloy of Sn arranged adjacent to each other.
12. According to a twelfth aspect of the present invention, a method for producing the metallic material for the connector in the aspect 11 comprises the steps of: forming the plating layer of Cu or the alloy of Cu and the plating layer of Sn or the alloy of Sn; and performing a thermal treatment so that the plating layer of Cu or the alloy of Cu and the plating layer of Sn or the alloy of Sn arranged adjacent to each other are thermally diffused to form the alloy layer of Cu—Sn.
13. According to a thirteenth aspect of the present invention, in the method for producing the metallic material for the connector in the aspect 12, in the step of performing the thermal treatment, a metallic material having the plating layer of Cu or the alloy of Cu and the plating layer of Sn or the alloy of Sn passes through an inside of a reflow furnace at an inner temperature between 300° C. and 800° C. for between three seconds and twenty seconds.
14. According to a fourteenth aspect of the present invention, the method for producing the metallic material for the connector in the aspect 12 or 13 further comprises the step of performing a cooling process passing through a liquid at a temperature between 20° C. and 80° C. for between one second and 100 seconds, after the step of performing the heat treatment.
15. According to a fifteenth aspect of the present invention, the method for producing the metallic material for the connector in the aspect 12 or 13 further comprises the step of performing a cooling process passing through a gas at a temperature between 20° C. and 60° C. for between one second and 300 seconds, and then passing through a liquid at a temperature between 20° C. and 80° C. for between one second and 100 seconds, after the step of performing the heat treatment.
16. According to a sixteenth aspect of the present invention, in the metallic material in one of the aspects 4 to 10, the alloy layer of Cu—Sn is formed not through intentional thermal diffusion between a plating layer of Cu or an alloy of Cu and a plating layer of Sn or an alloy of Sn arranged adjacent to each other In the present invention, the most surface is defined as an outermost surface layer as well.

The above and other aspects and advantages in accordance with the present invention will be further clarified by the following description, in reference to the drawings that are attached as properly.

BEST MODE FOR CARRYING OUT THE INVENTION

Here a connector in accordance with the present invention is the connector in which there are designed to be arranged a male connector that comprises a male terminal and to be arranged a female connector that comprises a female terminal as connectable with each other, and that there is designed to be formed an outermost surface layer on at least one of the male terminal and the female terminal with making use of a metallic material as an alloy layer of Cu—Sn. Moreover, there are designed to be arranged the male terminals as not less than one in general by being housed individually in a housing (not shown in any of the figures) regarding the male connector that comprises the male terminal. Further, there are designed to be arranged the female terminals as not less than one in general by being housed individually in a housing (not shown in any of the figures either) regarding the female connector that comprises the female terminal as similar thereto. Still further, the matter regarding the connector is the general matters in accordance with the present invention, and then any showing in the figures and further detailed description are omitted thereby.

Still further, there is designed to be produced the metallic material as preferably by performing a plating of an element, such as Ni or Cu or Sn or the like as principally, onto such as an electrically conductive base material or the like. Furthermore, regarding a nature of the plating thereon, a configuration of the individual thicknesses of the plating thereon, whether or not performing a process of a heat treatment, an amount of time at a temperature of the process of the heat treatment in a case of performing the process of the heat treatment, whether or not performing a process of cooling, an amount of time for performing the process of cooling in a case of performing the process of cooling, or the like, it is designed individually to be set as properly with corresponding to a manufacturing cost in total and with corresponding to quality of a part as required that is to be made use.

Figure 1:
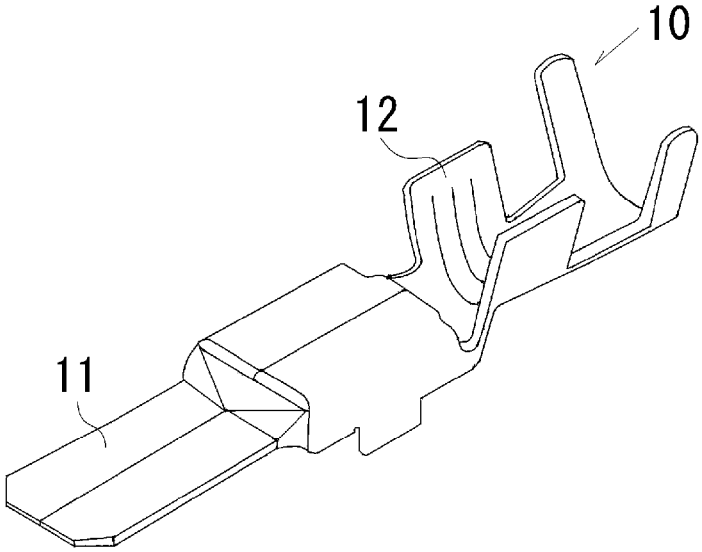
FIG. 1 is a diagrammatic perspective view showing a male terminal in a connector regarding one embodiment in accordance with the present invention.

Here FIG. 1 is a diagrammatic perspective view for showing a male terminal (10) in a connector regarding one embodiment in accordance with the present invention. Moreover, the male terminal (10) comprises a tab (11) as a part for connecting with a female terminal (20) and a wire barrel (12) as a part for jointing by pressing in order to perform a jointing by pressing with an electric wire. Further, there is designed to be formed the tab (11) as a flat plate shape, and then there is designed to be finished the same with an upper surface thereof and a lower surface thereof to be the individual surfaces as smooth respectively.

Figure 2:
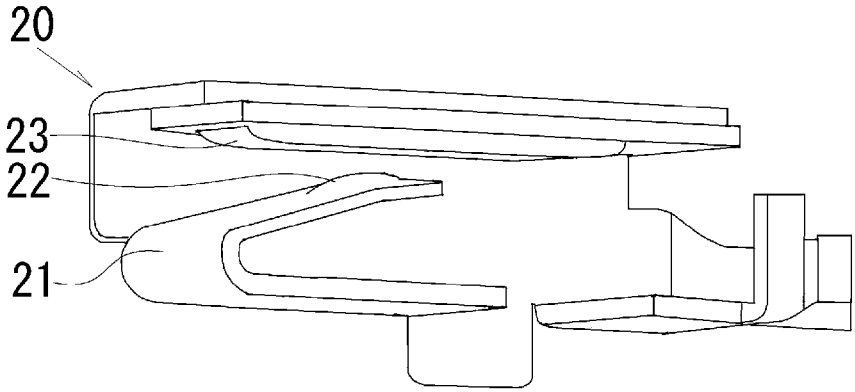
FIG. 2 is a diagrammatic perspective view showing an internal structure of a female terminal in the connector regarding one embodiment in accordance with the present invention.

Still further, FIG. 2 is a diagrammatic perspective view for showing an internal structure of a female terminal (20) in the connector regarding one embodiment in accordance with the present invention. And then the male terminal (10) as shown in FIG. 1 and the female terminal (20) as shown in FIG. 2 are designed to be as connectable with each other and designed to comprise the connector. Still further, a contact member part in the female terminal (20) for the male terminal (10) in accordance with FIG. 2 is designed to be as a hollow box type, and a tongue piece (21), a dimple (22) and a bead (23) are disposed on an inner side thereof.

Still further, the dimple (22) is the member of convex shape that is designed to be arranged on an upper part of the tongue piece (21), and then that is designed to be point contacted with a lower surface of the tab (11) at a period of the connection to the male terminal (10). Still further, the tongue piece (21) is designed to have a function as a spring to function a contact pressure, that is to say, a pressure to push the dimple (22) toward the tab (11). Furthermore, the bead (23) is the member of convex shape as well, and then that is designed to be contacted to the upper surface of the tab (11) and then to be received the contact pressure of which the dimple (22) forces toward the tab (11).

Here regarding at least a part of at least one of the male terminal (10) and the female terminal (20), an outermost surface thereof is designed to be formed of a metallic material as an alloy layer of Cu—Sn. Moreover, there may be designed to be formed only a part of the male terminal (10) and/or of the female terminal (20) with making use of the metallic material. And then it is desirable to be formed at least the contact member part with making use of the metallic material in the case thereof.

Further, it is desirable only for the male terminal (10) to be as the alloy of Cu—Sn rather than only for the female terminal (20) to comprise the alloy layer of Cu—Sn in a case where there is designed to be formed the most surface layer on either one of the male terminal (10) or the female terminal (20) with making use of the metallic material as the alloy layer of Cu—Sn. And then it is further preferable for both of the male terminal (10) and the female terminal (20) to be as the alloy of Cu—Sn.

Furthermore, a state of the most surface layer of the metallic material is defined here to be as an initial state for a connector in a case where the metallic material is designed to be made use for the connector in accordance with the present invention.

Figure 3:
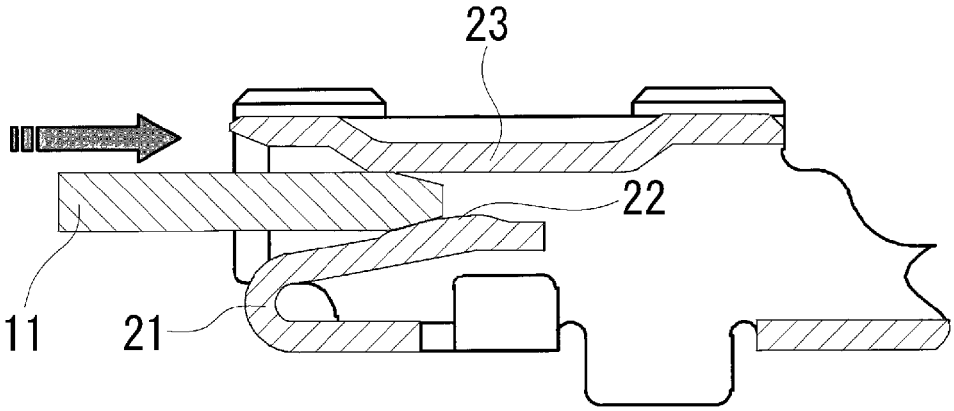
FIG. 3 is a schematic drawing of cross section showing a state of connection of a connector in accordance with the present invention.

Next, in a case of connecting the male terminal (10) to the female terminal (20) there is designed to insert the tab (11) into a space between the tongue piece (21) and the bead (23) as shown in the schematic drawing of cross section of FIG. 3. Moreover, there is designed to be contacted as slidable the bead (23) onto the upper surface of the tab (11) and there is designed to be contacted as slidable the dimple (22) onto the lower surface of the tab (11) as well in the case thereof. And then at a period of inserting the tab (11) completely there is designed to be contacted and held the tab (11) with being pressed against and at between the bead (23) and the dimple (22) under a state where each of the members is contacted with the tab (11) respectively. And hence there is designed to be performed a connection as electrically between the male terminal (10) and the female terminal (20) thereby.

Further, there is designed for the upper surface of the tab (11) and the lower surface thereof to be individual contact member parts regarding a side on the male terminal (10) in the case where there is performed the connection of therebetween in the manner. Still further, there is designed for the dimple (22) and the bead (23) to be individual contact member parts regarding a side on the female terminal (20) on the contrary thereto.

Furthermore, in a case where there is a difference on a hardness of the individual surfaces of between the male terminal (10) and the female terminal (20), the softer surface thereof becomes to be rubbed worn away easier, and then the smaller an amount of the part to be worn away the smaller the force for inserting. Accordingly, it is desirable to harden a material at a side of which a contact area thereof as larger with corresponding to a locus of the individual contact member parts for each of the male terminal and the female terminal at the period of the connection to therebetween. And then thereby it becomes possible to reduce a resistance for inserting the connector and extracting, and it becomes possible to reduce the force for inserting as well that is required at a time of assembling the connector. And it becomes possible to improve labor effectiveness on working for assembling thereof as well, and hence it becomes possible to reduce a tiredness of such a worker.

Next, regarding a connector in accordance with another embodiment as preferred to the present invention, there is designed to be provided a male terminal and a female terminal that are connectable to each other, and there is designed to be formed all over a surface of the terminal regarding either one of the male terminal or the female terminal or to be formed at least a contact member part of the same with making use of a metallic material on which an outermost surface thereof is designed to be comprised of an alloy layer of Cu—Sn, and also there is designed to be formed at least a contact member part of the other one of the male terminal or the female terminal with making use of a metallic material on which an outermost surface thereof is designed to be comprised of a layer of Sn or an alloy layer of Sn. Here in accordance with the male terminal there may be a probability to occur with an area as larger regarding the fretting phenomenon or a forming of a pure layer of Sn which is a cause of the force for inserting as higher, due to the contact member part thereof as a flat plate shape. Moreover, in the case of the female terminal on the contrary thereto, the area thereof becomes to be smaller due to the contact member part thereof as a hemispherical shape. Therefore, it is desirable for the outermost surface of the male terminal to be comprised of the alloy layer of Cu—Sn, and for the outermost surface of the female terminal to be comprised of the layer of Sn or of the alloy layer of Sn.

Further, regarding the connector in accordance with the present embodiment, there is designed for the male terminal to be as the terminal that has the surface to be harder as the side for the contact member part thereof to have the contact area as larger, and there is designed for the female terminal to be as the terminal that has the surface to be softer as the side for the contact member part thereof to have the contact area as smaller, with taking into consideration of the locus of the individual contact member parts for each of the male terminal and the female terminal at the period of the connection to therebetween. And then thereby it becomes able to reduce the amount of the part to be worn away (per a unit area) from the surface for the contact member part thereof to have the contact area as larger, and hence it becomes able to enhance the effect of reducing the force for inserting.

Still further, there is designed to be formed the male terminal in general with having the flat shape in order to insert with ease. Still further, there is designed to be formed the female terminal on the contrary thereto with having a shape by which the same become to have a function as a spring by being performed a process of bending work onto either one of an upper side of an inner surface thereof or a lower side thereof or both of the sides thereof. Still further, there is designed to be formed the contact member part at the side on the female terminal as being protruded toward the side on the male terminal in general. And then thereby there may be a case where the male terminal is produced by punching out a flat plate directly, meanwhile, there are a large number of cases where the female terminal is produced by performing a process of bending. And hence it is desirable for the female terminal to comprise the metallic material with having the hardness as softer than that of the male terminal from a point of view of the easiness on processing. Thus, in a case of further performing a process of bending thereof in accordance with a further strict specification in particular in order to correspond to a demand as smaller in size thereof in the recent years, it is further preferable to apply the present invention thereto that comprises the female terminal with which it becomes able to perform the process as easier.

Further, there becomes another reason in addition thereto that it is effective to select the male terminal as an object to be performed a process of hardening in accordance with the present embodiment, because the contact area of the male terminal with corresponding to the locus of the contact member part thereof becomes to be larger than the contact area of the female terminal with corresponding to the locus of the contact member part thereof regarding the insertion of the terminal with taking into consideration of the configuration thereof.

Furthermore, there is designed for the connector to be mounted onto a motor vehicle as a connector for being mounted on a motor vehicle for instance. However, the usage of the connector in accordance with the present invention is not limited to the connector for being mounted on a motor vehicle, and then it is possible to apply the same to any connector for any other usage of an electrical device or an electronic device or the like.

Next, a metallic material for a connector that comprises the connector in accordance with the present invention will be described in detail below.

Here the metallic material for the connector in accordance with the present invention is the metallic material to form at least a part of a male terminal or a part of a female terminal in an electrical device or in an electronic device, in which there is provided an alloy layer of Cu—Sn on an outermost surface thereof. Moreover, there is designed as preferred to be made use of a material in which a concentration of Cu is designed to be decreased gradually toward the surface thereof, a material in which Sn or an alloy of Sn is designed to be diffused into an alloy layer of Cu—Sn, or the like. Further, it may be available to design for Sn or the alloy of Sn as a part thereof to be exposed from the surface of the alloy layer of Cu—Sn.

Still further, there is no limitation in particular regarding a layer that is directly under a region where there is designed to be provided the alloy layer of Cu—Sn. And then there may be available to be provided the alloy layer of Cu—Sn onto an electrically conductive substrate for instance, or there may be available to be provided a metal layer or an alloy layer, that is comprised of any one type or any two types selected from Cu, an alloy of Cu, Ni, an alloy of Ni, Fe, an alloy of Fe, Co and an alloy of Co, onto an electrically conductive substrate and then to be provided the alloy layer of Cu—Sn thereto as the outermost surface thereof.

Figure 4:
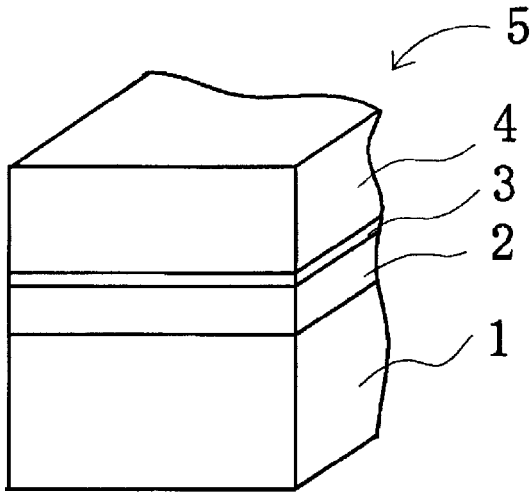
FIG. 4 is an explanatory drawing from a diagrammatic perspective view showing one embodiment regarding a metallic material in accordance with the present invention.

Here FIG. 4 is a drawing from a diagrammatic perspective view for showing a metallic material for a connector regarding one embodiment as preferably in accordance with the present invention, wherein the metallic material for the connector (5) comprises an electrically conductive substrate (1), an underlayer (2) which is comprised of Ni and is provided thereto, an intermediate layer (3) which is comprised of Cu and is provided thereto, and an alloy layer of Cu—Sn (4) which is provided thereto.

Figure 5:
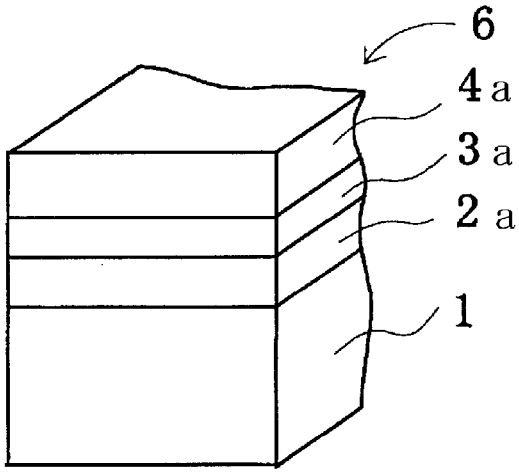
FIG. 5 is an explanatory drawing from a diagrammatic perspective view showing a layered body by plating to be made use for a production of a metallic material in accordance with the present invention.

Moreover, the metallic material for the connector (5) is designed to be produced by the following processes of: performing a process of plating for forming a layer of Ni (an N-layer) (2*a*), a layer of Cu (a C-layer) (3*a*) and a layer of Sn (an S-layer) (4*a*) in order onto an electrically conductive substrate (1) as shown in a drawing from a diagrammatic perspective view of FIG. 5 in order to form a layered body by plating (6); performing each of the diffusions of Cu in the C-layer (3*a*) and Sn in the S-layer (4*a*) by performing a process of treating with heat; and then forming an alloy layer of Cu—Sn on an outermost surface thereof by performing a reaction therebetween. Further, there is designed to be prevented a thermal diffusion of any of the elements from the base substrate by making use of the N-layer (2*a*) on the contrary thereto at the period of performing the process of treating with heat. Still further, there is designed to be determined a volume ratio as an S/C of between a volume of the S-layer (4*a*) and that of the C-layer (3*a*), with taking into consideration of a thickness of the alloy layer of Cu—Sn (4) that is required, in order to design the S-layer (4*a*) to be disappeared after performing the process of treating with heat, and in order to design the C-layer (3*a*) to be remained thereafter as an intermediate layer on the contrary thereto. Still further, it is not necessary for a thickness of the C-layer (3*a*) (the thickness of the intermediate layer (3)) in particular after performing the process of treating with heat to be specified as strictly on the contrary thereto. And hence it becomes able to perform as easily the designing of the layered body by plating (6) and to perform the process of treating with heat. Therefore, it becomes able to obtain the metallic material for the connector (5) in accordance with the present invention with an ease of the production and with being superior in productivity thereof.

Still further, it is desirable to perform a process of cooling after performing the process of treating with heat in the case of forming the alloy layer of Cu—Sn as the outermost surface thereof by performing the diffusion of between Cu in the C-layer (3*a*) ad Sn in the S-layer (4*a*). And then by performing the process of cooling under a condition as properly, it becomes possible to form the alloy layer of Cu—Sn as a gradation like structure in place of a layered structure regarding the diffusion of between Cu and Sn. Still further, it becomes able to form the alloy layer of Cu—Sn with remaining a pure Sn on the outermost surface thereof and with remaining the same as partially thereon as well.

Still further, it may be able to perform the process of treating with heat by making use of any of the methods, however, it is desirable for the process to be designed by which there becomes to be passed the layered body by plating (6) through an inside of a reflow furnace with a temperature at the inside of the furnace of between 300° C. and 800° C. and with an amount of time for three seconds and twenty seconds.

It may be able to perform the process of cooping by making use of any of the methods, however, it is desirable for the process to be designed by which there becomes to be performed by being passed the layered body through an inside of a liquid mass with a temperature of between 20° C. and 80° C. and with an amount of time for between one second and 100 seconds thereafter, or it is more desirable to be performed by being passed through an inside of a gaseous body with a temperature of between 20° C. and 60° C. and with an amount of time for between one second and 300 seconds thereafter and then to be performed by being passed through an inside of a liquid mass with a temperature of between 20° C. and 80° C. and with an amount of time for between one second and 100 seconds thereafter. It is further preferable to be performed by being passed through an inside of a liquid mass with a temperature of between 30° C. and 50° C. and with an amount of time for between five seconds and fifteen seconds thereafter.

Next, there is designed for a thickness of the C-layer (3*a*) in the layered body by plating (6) to be as not less than 0.01 μm in general. Moreover, it is desirable for an upper limit to be as approximately 5.0 μm, with taking into consideration of a point of view of a practical aspect thereof, a cost of the materials, a cost of the production, or the like.

Further, it is further preferable for the thickness of the C-layer (3*a*) to be as not thinner than 0.05 μm but not thicker than 0.5 μm. Furthermore, there may be occurred micro-pores as a large number thereof in the C-layer (intermediate layer (3)) after performing the process of treating with heat in a case where there is designed to be made use of Cu for the C-layer (3*a*) and then where the Cu layer (3*a*) is thinner. And then thereby there may be a case to be happened that the barrier function as the intermediate layer is lost. And hence it is further preferable for the thickness of the C-layer (3*a*) to be as slightly thicker in the case where there is designed to be made use of Cu, which is compared to that in a case where there is designed to be made use of an alloy of Cu.

Next, regarding the S-layer (4*a*) in accordance with the present invention, it is required an amount of time as longer with depending on a thickness thereof for the S-layer (4*a*) to be reacted completely. And then after a process of treating with heat there may be a case where Sn is diffused into the alloy of Cu—Sn (4) and then is remained with having a punctuate shape or an island shape. However, there is seldom happened for the function of the metallic material for the connector (5) to be worsened due to the case thereof. Moreover, there may be a case where a part of Sn or the alloy of Sn that is diffused becomes to be exposed onto the surface of the alloy layer of Cu—Sn (4) in the case thereof. And then in the case thereof it is desirable for an exposed area of Sn or of the alloy of Sn that is exposed thereto to be as sufficiently smaller comparing to an area of the faces in total of Sn or the alloy of Sn that is diffused.

It is not desirable for a product which is finished the process of the treatment of reflow in a case where there is remained the C-layer (3*a*) as excessively thicker on the underlayer, due to a case in general where there may be diffused the excessive element from the layer to the surface at a time when the same receives a thermal load, and then due to a case where there may become a cause to happen an oxidation thereof and an increase of the resistance thereof. However, in a case on the contrary thereto where there is existed Cu—Sn on the outermost surface layer thereof and also the pure Sn is diffused or remained, there becomes to be received the diffusion of Cu that is remained as excessively in the underlayer by the pure Sn, and then thereby it becomes possible to suppress the diffusion of the copper to the outermost surface thereof, to suppress the oxidation thereof and then to suppress the increase of the resistance thereof.

Still further, it becomes possible for the diffused Sn to react with the excessive amount thereof and then to further diffuse Sn in the case where there is designed to be diffused Sn into the alloy layer of Cu—Sn (4) as the outermost surface layer even if there is designed to be remained the Cu layer (intermediate layer) (3) as thicker. Furthermore, an effect of the diffusion is remarkable under an environment with a temperature as higher. And hence it becomes possible to obtain a domain for a designing of condition as wider regarding the plating thereon and the production thereof, and then thereby it becomes possible to maintain the individual properties thereof with an amount of time for longer even under the environment with the temperature as higher.

Thus, the material in which Sn or the alloy of Sn is designed to be diffused into the alloy layer of Cu—Sn (4) is one embodiment regarding the metallic material in accordance with the present invention as well. Here Sn or the alloy of Sn that is diffused as the punctuate shape or as the island shape from the point of view of cross section is defined that a rate of occupation regarding an area of Sn or of the alloy of Sn in the alloy layer of Cu—Sn, which is approximately equivalent to a rate of occupation regarding a volume thereof, to be as between zero percent and sixty percent in accordance with an image by mapping that is obtained by making use of an instrument of an Auger electron spectroscopy (AES) or the like. Moreover, regarding Sn or the alloy of Sn that is diffused as the island shape from the point of view of cross section, there is existing a case where a part thereof to be exposed onto the outermost surface thereof, meanwhile, there is existing another case as well where there is none of the part thereof to be exposed onto the outermost surface thereof. As a typical example, regarding the case where the part thereof to be exposed onto the outermost surface thereof, there is existing a part of the alloy of Cu—Sn at the inside of Sn or the alloy of Sn that is exposed onto the outermost surface thereof from the point of view of cross section, meanwhile, there is existing Sn or the alloy of Sn with having a doughnut shape from a point of view of plane for the outermost surface thereof on the contrary thereto. And then there is no problem at all for Sn or the alloy of Sn to be dissolved and then removed by making use of an agent, that is remained only in the vicinity of the surface thereof among Sn or the alloy of Sn that is diffused and then remained in the alloy layer of Cu—Sn (4). Furthermore, there may be a case as preferred to remove Sn or the alloy of Sn that is remained only in the vicinity of the surface of the alloy layer of Cu—Sn (4), because the case becomes to be a cause for the fretting phenomenon which is described above in a case where there is existing Sn or the alloy of Sn at a state as sticking out from the surface of the alloy layer of Cu—Sn (4) with a larger amount thereof.

Here each of FIG. 6 through FIG. 10 is a picture for showing an image by mapping that is obtained by making use of the instrument of the AES for one sample regarding the metallic material in accordance with the present invention. And first of all there is obtained the sample with an oblique section of thirty degrees by making use of a focused ion beam (FIB) with setting the sample to be inclined as sixty degrees, and the sample is assumed to be as a sample for an Auger analysis and measurement (AES). Moreover, there is performed the AES with the sample to be inclined for having the oblique section of thirty degrees to become horizontal. And hence there becomes to be obtained each of the electron images of the AES. Further, it is found out in the alloy layer of Cu—Sn as the outermost surface layer thereon that there is existed an intermetallic compound of Cu—Sn together therewith, such as $Cu_6Sn_5$ or $Cu_3Sn$ or $Cu_4Sn$ or the like.

Figure 6:
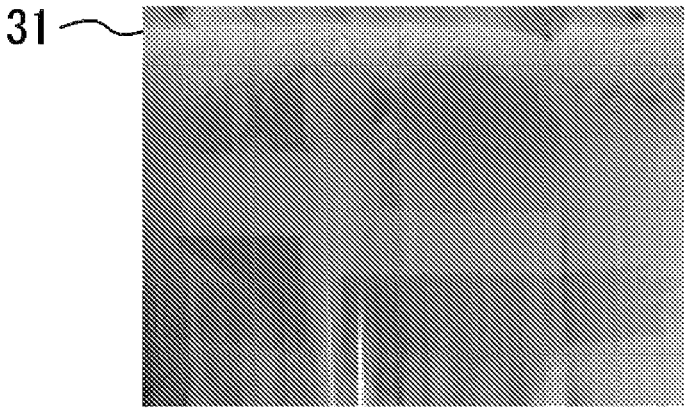
FIG. 6 is an SEM photograph by making use of an AES instrument showing one example regarding a measuring region.
Figure 7:
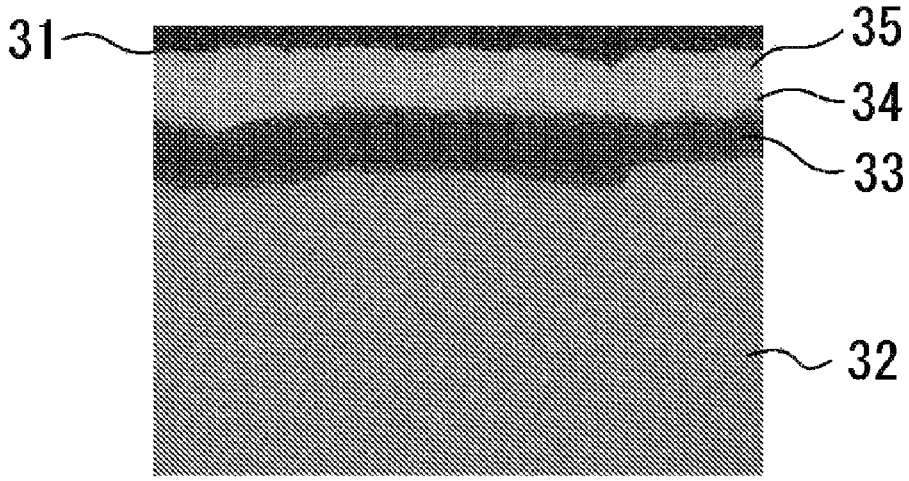
FIG. 7 is a picture showing an image by mapping (Sn—Cu—Ni map) obtained by making use of the AES instrument regarding the measuring region as shown in FIG. 6.
Figure 8:
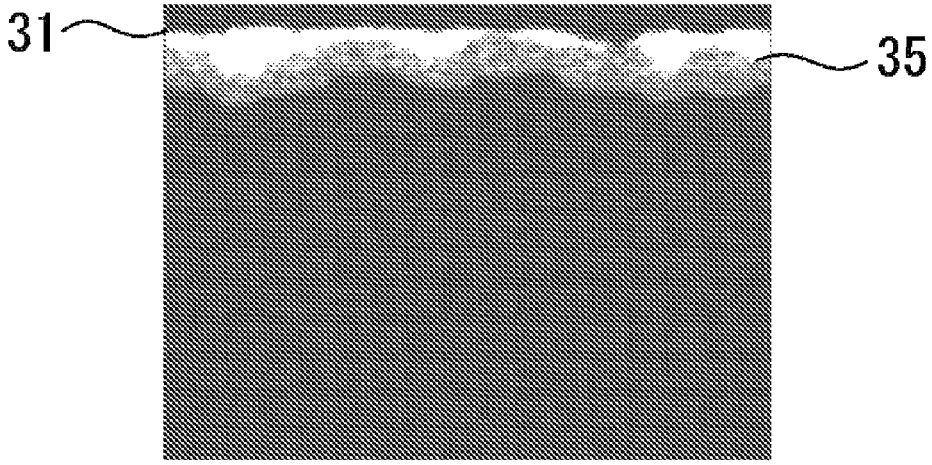
FIG. 8 is a picture showing an image by mapping (Sn map) obtained by making use of the AES instrument regarding the measuring region as shown in FIG. 6.
Figure 9:
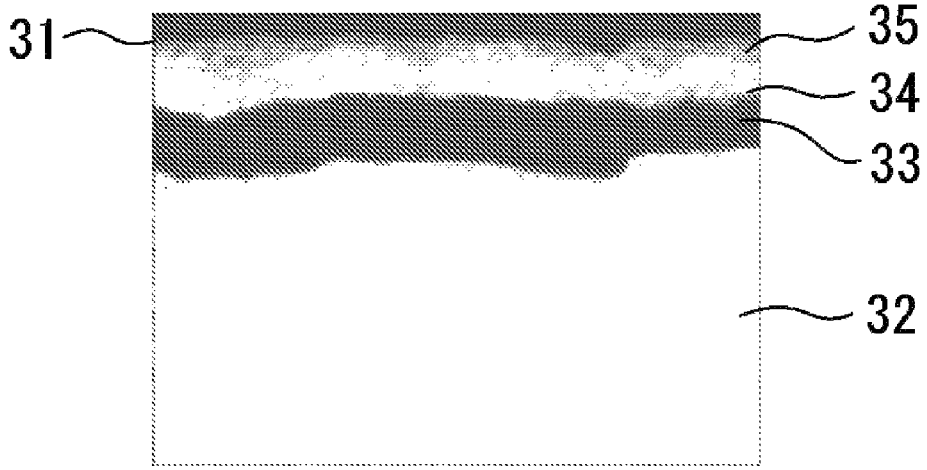
FIG. 9 is a picture showing an image by mapping (Cu map) obtained by making use of the AES instrument regarding the measuring region as shown in FIG. 6.
Figure 10:
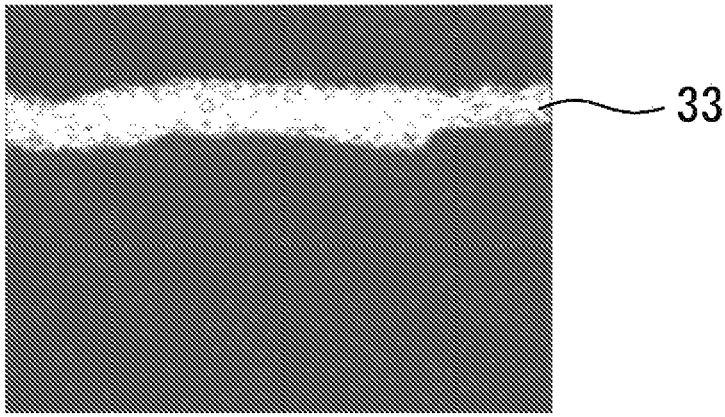
FIG. 10 is a picture showing an image by mapping (Ni map) obtained by making use of the AES instrument regarding the measuring region as shown in FIG. 6.

Still further, FIG. 6 is an SEM photograph (having a width of 11.7 μm) for showing a measuring region of the AES measurement on a cross section of the sample. Still further, each of FIG. 7 through FIG. 10 is a picture for showing an image by mapping regarding a metallographic structure of the measuring region thereof as shown in FIG. 6. And then FIG. 7 is an Sn—Cu—Ni map for showing Sn, Cu and Ni with making use of lightness and darkness of color as different from each other, meanwhile, FIG. 8 is an Sn map for showing Sn with making use of white color, meanwhile, FIG. 9 is a Cu map for showing Cu with making use of white color, meanwhile, FIG. 10 is an Ni map for showing Ni with making use of white color.

Still further, the symbol of (31) designates a surface of the alloy layer of Cu—Sn (outermost layer) in accordance with each of FIG. 7 through FIG. 10, the symbol of (32) designates a substrate, the symbol of (33) designates an underlayer, the symbol of (34) designates an intermediate layer, and the symbol of (35) designates the alloy layer of Cu—Sn (outermost layer). Still further, there is shown the alloy layer of Cu—Sn (35) with making use of white color in accordance with FIG. 8, and then a part at a side for the surface (31) as further brighter indicates that there is contained Sn as a larger number thereof. Still further, there is shown the underlayer (33) with making use of black color in accordance with FIG. 9, and then which indicates that there is not contained substantially any Cu in the underlayer (33). Still further, there is shown only the underlayer (33) with making use of white color in accordance with FIG. 10, and then which indicates that there is not diffused Ni into any other region except the underlayer (33).

Still further, it is found out as shown in each of FIG. 7 through FIG. 10 that there is seldom remained Sn or the alloy of Sn at the inside of the alloy layer of Cu—Sn (35) (an area that Sn or the alloy of Sn occupies is determined to be as between zero percent and ten percent). Still further, it is found out as shown in FIG. 9 that there is decreased gradually Cu toward the surface thereof.

Figure 11:
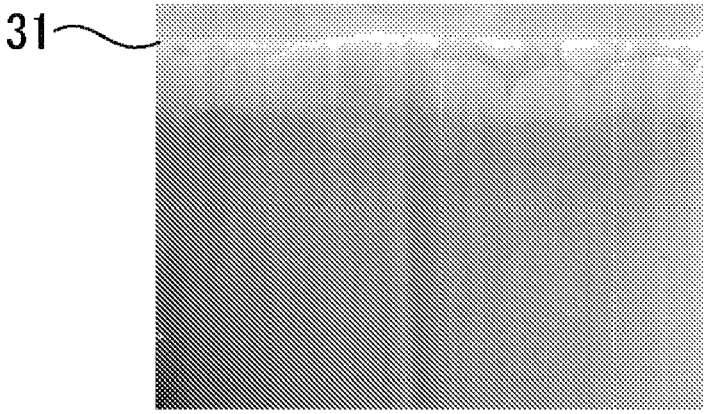
FIG. 11 is another SEM photograph by making use of the AES instrument showing one example regarding another measuring region.
Figure 12:
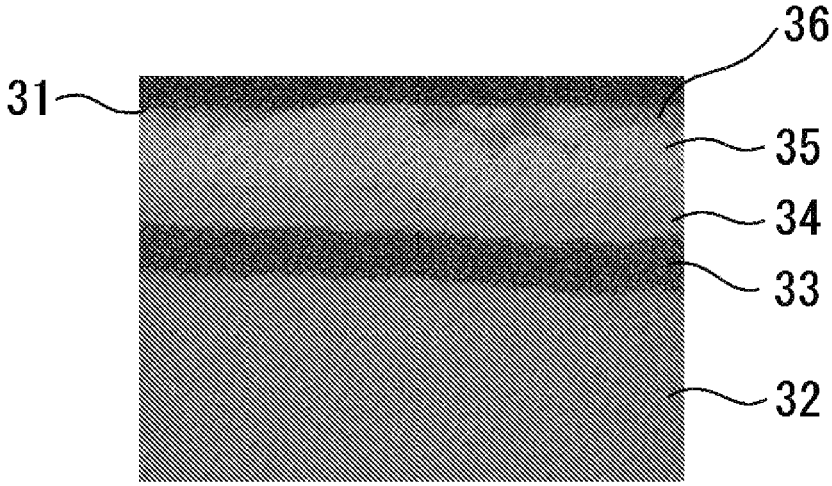
FIG. 12 is a picture showing an image by mapping (Sn—Cu—Ni map) obtained by making use of the AES instrument regarding the measuring region as shown in FIG. 11.
Figure 13:
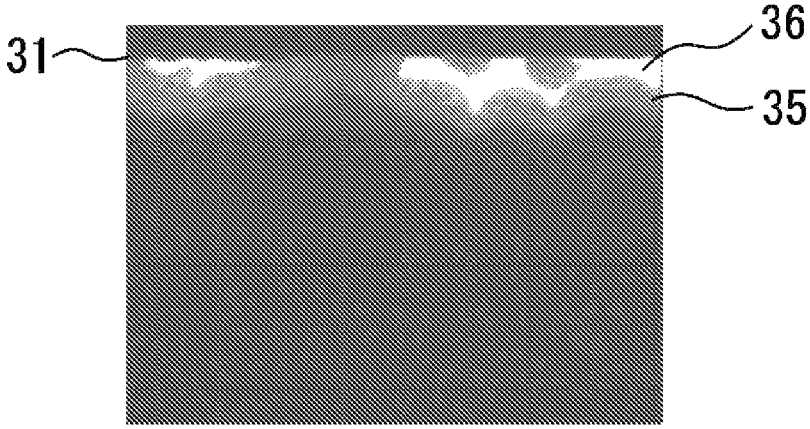
FIG. 13 is a picture showing an image by mapping (Sn map) obtained by making use of the AES instrument regarding the measuring region as shown in FIG. 11.
Figure 14:
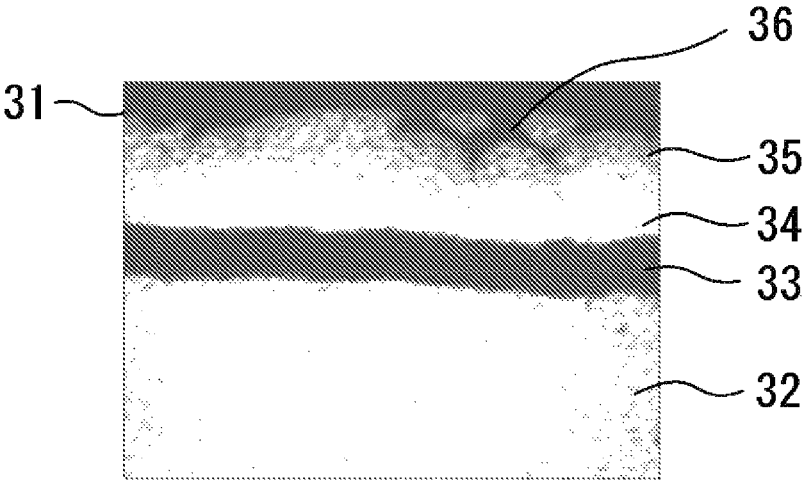
FIG. 14 is a picture showing an image by mapping (Cu map) obtained by making use of the AES instrument regarding the measuring region as shown in FIG. 11.
Figure 15:
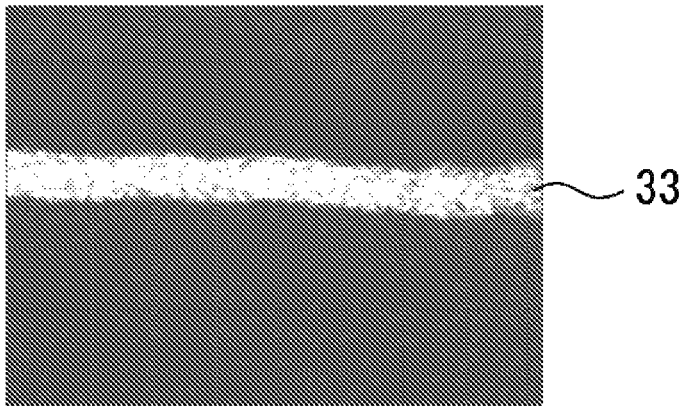
FIG. 15 is a picture showing an image by mapping (Ni map) obtained by making use of the AES instrument regarding the measuring region as shown in FIG. 11.

Next, each of FIG. 11 through FIG. 15 is a picture for showing an image by mapping for another sample regarding the other metallic material in accordance with the present invention, which is obtained by making use of the instrument of the AES as similar to that in accordance with each of FIG. 7 through FIG. 10. Still further, FIG. 11 is an SEM photograph (having a width of 11.7 μm) for showing a measuring region of the AES measurement on a cross section of the sample. Still further, each of FIG. 12 through FIG. 15 is a picture for showing an image by mapping regarding a metallographic structure of the measuring region thereof as shown in FIG. 11. And then FIG. 12 is an Sn—Cu—Ni map for showing Sn, Cu and Ni with making use of lightness and darkness of color as different from each other, meanwhile, FIG. 13 is an Sn map for showing Sn with making use of white color, meanwhile, FIG. 14 is a Cu map for showing Cu with making use of white color, meanwhile, FIG. 15 is an Ni map for showing Ni with making use of white color. Still further, the symbol of (31) designates a surface of the alloy layer of Cu—Sn in accordance with each of FIG. 11 through FIG. 15, the symbol of (32) designates a substrate, the symbol of (33) designates an underlayer, the symbol of (34) designates an intermediate layer, and the symbol of (35) designates the alloy layer of Cu—Sn. Still further, there is shown Sn or an alloy of Sn (36) to be diffused as an island shape into the alloy layer of Cu—Sn (35) in accordance with FIG. 12 as shown with making use of a further darker color. Still further, there is shown the alloy layer of Cu—Sn (35) as further brighter in accordance with FIG. 13, and then which indicates that there is contained Sn or the alloy of Sn (36) in a part as an island shape with making use of a further white color at a side for the surface (31) thereof. Still further, there is shown the underlayer (33) and Sn or the alloy of Sn (36) as an island shape in accordance with FIG. 14, and then which indicates that there is not contained substantially any Cu in each of the regions thereof respectively. Still further, there is shown only the underlayer (33) with making use of white color in accordance with FIG. 15, and then which indicates that there is not diffused Ni into any other region except the underlayer (33).

Still further, it is found out as shown in FIG. 12 through FIG. 15 that an area of the region where there is occupied by Sn or the alloy of Sn in the alloy layer of Cu—Sn on the layer of Ni is between thirty percent and sixty percent in total. Still further, it is found out that there is decreased gradually Cu toward the surface thereof.

Figure 16:
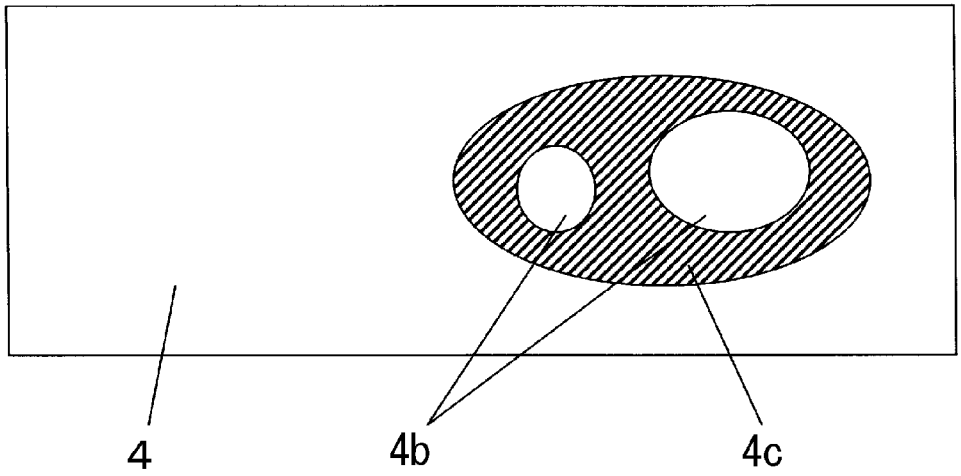
FIG. 16 is a schematic plan view showing one example regarding a distribution of an alloy of Cu—Sn on a surface of an alloy layer of Cu—Sn and a distribution of Sn thereon, that corresponds to one part of the measuring region as shown in FIG. 11.
Figure 17:
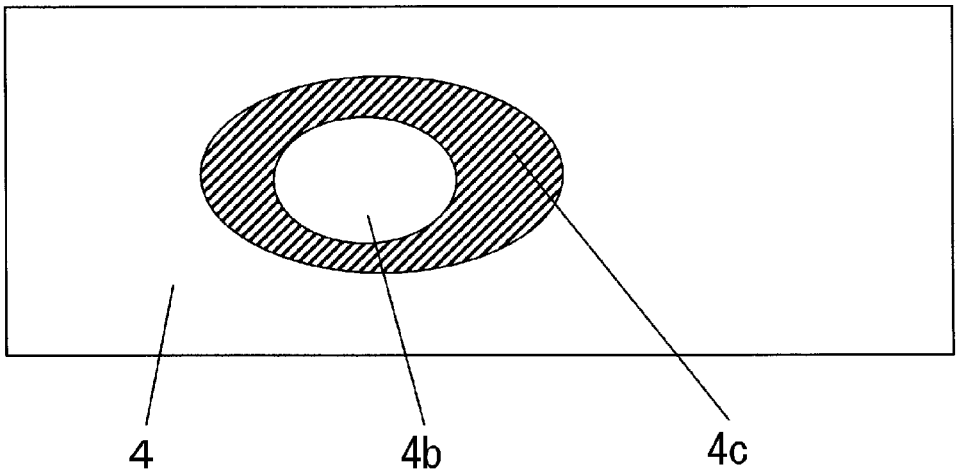
FIG. 17 is a schematic plan view showing another example regarding another distribution of the alloy of Cu—Sn on the surface of the alloy layer of Cu—Sn and another distribution of Sn thereon, that corresponds to another part of the measuring region as shown in FIG. 11.

Still further, in accordance with the metallic material as the present sample, there is diffused Sn or the alloy of Sn (36) as the island shape into the alloy layer of Cu—Sn (35) from the view of cross section as shown in FIG. 12, and then there becomes to be exposed the part of Sn or the alloy of Sn (36) as the island shape onto the surface (31) of the alloy layer of Cu—Sn (35). Still further, there is existed the part of the alloy of Cu—Sn at the inside of Sn or of the alloy of Sn that is exposed on the alloy layer of Cu—Sn as schematically shown in FIG. 16 and in FIG. 17, that there is exposed Sn or the alloy of Sn as approximately looked like a doughnut shape from a point of view of the surface thereof. Still further, the number (4) in accordance with FIG. 16 and with FIG. 17 designates a metal layer of Cu—Sn by plating on the outermost surface thereof, the number (4*b*) designates an intermetallic compound of Cu—Sn, and the number (4*c*) designates a part of Sn or the alloy of Sn by which there is formed the layer of Sn (the S-layer) in accordance with FIG. 2. Still further, the intermetallic compound of Cu—Sn (4*b*) becomes to form a part of the layer of the outermost surface thereof by being combined with the alloy layer of Cu—Sn (4).

Still further, there becomes to be generated such a state thereof in a case where the volume ratio of between the volume of the S-layer in the layered body by plating and that of the C-layer to be as smaller than 1.90, which is the condition that there is not remained any of the layer of Sn on the surface of the metallic material in the case where whole of Sn become to be alloyed as Cu—Sn, and in a case where there is designed to be finished the process of treating with heat by performing such as a process of quenching rapidly under a state that there is not completely alloyed Sn to become Cu—Sn as well. And then in accordance with the state thereof, there becomes to be contacted the alloy of Cu—Sn to the contact member part thereof or the like, that is existing around Sn or the alloy of Sn which is exposed onto the surface of the alloy layer of Cu—Sn, and that is further harder than Sn thereon or the alloy of Sn thereon. And hence it becomes able to prevent Sn thereon or the alloy of Sn thereon that becomes to be exposed onto the surface of the alloy layer of Cu—Sn from being worn away as less as possible. It is less affected by the fretting phenomenon. Furthermore, it becomes able to obtain a further advantage that there becomes to be stabilized the contact resistance of therebetween, because there is remained a margin that there becomes to be reacted to between Cu which is exiting at a side for a lower layer of the alloy layer of Cu—Sn and Sn or the alloy of Sn which is diffused into the inside of the alloy layer of Cu—Sn at a period of maintaining the material at a temperature as higher and then that there becomes to be further formed an alloy of Cu—Sn, and then because there becomes not to be formed any of CuO or the like on the surface thereof.

Here in accordance with the present invention, there is no limitation in particular regarding a thickness of the intermediate layer (3) in the metallic material for the connector (5). However, it is desirable to be as between 0.01 μm and 1.0 μm, or it is further preferable to be as between 0.05 μm and 0.5 μm. Moreover, there is no limitation in particular regarding a thickness of the alloy layer of Cu—Sn (4) in the metallic material for the connector (5) in accordance with the present invention. However, it is desirable to be as between 0.05 μm and 2.0 μm, or it is further preferable to be as between 0.1 μm and 1.0 μm.

Further, there is designed to be provided the intermediate layer (3) which is comprised of copper or the alloy of copper in the metallic material for the connector (5) in accordance with the present invention. The properties of inserting and extracting the terminal or the like are seldom worsened, regarding the metallic material even in a case where there may be assumed for the C-layer (3*a*) to be disappeared together with the S-layer (4*a*) after performing the process of treating with heat for the layered body by plating (6).

Still further, it is desirable for the alloy layer of Cu—Sn by plating as the outermost surface thereof in accordance with the present invention to be designed as decreasing the concentration of Cu as gradually from a side for the substrate toward the surface thereof. And then in the case thereof there becomes not to be formed clearly a boundary of between the alloy layer of Cu—Sn and the layer of Cu which is existing under the alloy layer or a boundary of between the alloy layer and the substrate.

Still further, it is able to design to obtain a distribution of the concentration of Cu as both of a distribution of the concentration thereof in a layered formation and a distribution of the concentration thereof in a gradation like formation by controlling a condition of the production. And then it is further preferable to be designed as the gradation like formation from a point of view of the easiness regarding the production.

Still further, it becomes able to design to obtain the metallic material in accordance with the present invention that comprises the contact member part in the terminal on which there is designed for the outermost surface thereof to be as the alloy layer of Cu—Sn with decreasing gradually the concentration of Cu toward the surface thereof and that comprises a joint part for electric wire by pressing to be as the layer of Sn. And then it becomes able to produce the metallic material in accordance with the aspect thereof by performing a process of plating the S-layer as thinly at which there is designed for a part thereof to be as the contact member part in the terminal thereon with making use of a masking or the like, and then by performing a process of plating the S-layer as thickly at which there is designed for a part thereof to be as the joint part for electric wire by pressing and then thereafter by performing a process of treating with heat. Therefore, it becomes able to produce the metallic material as easier in accordance with the method, on which the material on the outermost surface thereof is different thereby from region to region thereon.

Still further, in a case of performing the process of treating with heat for the layered body by plating (6) by making use of a reflow treatment (continuous processing), it is desirable for a substantial temperature of the layered body by plating (6) to be as between 232° C. and 500° C., with an amount of time for between 0.1 second and ten minutes, or therewith for not longer than 100 seconds as it is more desirable, or therewith for not longer than ten seconds as it is further preferable. Still further, there becomes to be realized the process of the reflow treatment by performing a heating with maintaining a temperature at an inside of a reflow furnace as between 500° C. and 900° C., and with an amount of time for not longer than ten minutes for instance, or therewith for not longer than ten seconds as it is more desirable. And then it is preferable to perform the process of the reflow treatment by performing a control of the temperature at the inside of the reflow furnace, because it is easier to perform a measurement of the temperature at the inside of the reflow furnace in practice rather than that of the temperature in accordance with the substantial temperature thereof. Still further, in a case of performing the process thereof by making use of a batch processing, it is desirable for the layered body to be performed by being maintained in a furnace which has a temperature of between 50° C. and 250° C., with an amount of time for between several tens minutes and several hours. Furthermore, there are required for the temperature thereof or the amount of time for heating thereof or the like in the case of performing the process of treating with heat by making use of the reflow treatment to be set as a condition that is pursuant to such as each of the thicknesses of the N-layer (2*a*) and the C-layer (3*a*) and the S-layer (4*a*) in the layered body by plating (6) or the like. And then it is able to set each of the specific conditions thereof as properly, that will be described in detail later in accordance with the following Examples.

In the present invention, there is designed for the electrically conductive substrate (1) to be made use as properly of copper, an alloy of copper, such as a phosphor bronze, a brass, a white metal, a beryllium copper, a Corson alloy, or the like, iron, an alloy of iron, such as a stainless steel or the like, a composite material, such as a material of iron to be covered by copper, a material of iron to be covered by nickel, or the like, an alloy of nickel as a variety thereof, an alloy of aluminum as a variety thereof, or the like, that each of the materials individually have the electrical conductivities and the mechanical strengths and the heat resisting properties that are required for the terminal respectively.

Moreover, it is preferable to apply the copper based material in particular of copper or the copper alloy or the like among the metal and the alloys (materials), as it is superior in a balance of between the electrical conductivity thereof and the mechanical strength thereof. Further, in a case where there is designed for the electrically conductive substrate (1) to be made use of the other material except the copper based material, it becomes able to improve a corrosion resistance thereof and an adherence to between the underlayer (2) by being covered a surface thereof with making use of copper or an alloy of copper.

The underlayer (2) provided on the electrically conductive substrate (1) is preferably formed of a metal of Ni or Co or Fe, an alloy of Ni, such as a system of Ni—P, a system of Ni—Sn, a system of Co—P, a system of Ni—Co, a system of Ni—Co—P, a system of Ni—Cu, a system of Ni—Cr, a system of Ni—Zn, a system of Ni—Fe, or the like, an alloy of Fe, an alloy of Co, or the like, that individually have the barrier function to prevent any of the elements in the substrate from the occurrence of the thermal diffusion into the alloy layer of Cu—Sn (4). And then thereby it becomes able to obtain a processability of plating thereon as excellently, and there is no problem at all from a point of view of price thereof as well. It is further preferable to be made use of Ni or the alloy of Ni in particular among the elements because there is not become to be weakened the barrier function thereof even under an environment at a temperature as higher.

Still further, the metal (alloy) of Ni or the like to be made use for the underlayer (2) has a melting point as high as not lower than 1000° C. While, a temperature of an environment for a usage of a connector to be connected is normally lower on the contrary thereto as not higher than 200° C. And then thereby it is difficult for the underlayer (2) to be occurred the thermal diffusion of itself. And hence it becomes able to come out the barrier function thereof as effectively. Still further, the underlayer (2) has a further function to enhance an adherence of between the electrically conductive substrate (1) and the intermediate layer (3) with corresponding to the material to be made use for the electrically conductive substrate (1).

Still further, regarding a thickness of the underlayer (2), it becomes not able to function the barrier function as sufficiently in a case where it is thinner than 0.05 μm. While, there becomes to be larger a distortion due to the plating thereon in a case where it is thicker than 3 μm on the contrary thereto. And then thereby there becomes to be peeled off as easier the layer from the substrate. And hence it is desirable to be as between 0.05 μm and 3 μm. Still further, it is more desirable for an upper limit regarding the thickness of the underlayer (2) to be as not thicker than 1.5 μm, or it is further preferable to be as not thicker than 0.5 μm, with taking into consideration of workability on the terminal.

Still further, it may be available to design the underlayer (2) as one layer or layers as not less than two thereof. Furthermore, in a case where there is designed to be the layers as not less than two thereof, it becomes able to obtain a further advantage of being able to set as properly the barrier function or the function to enhance the adherence to therebetween or the like, due to a relation to between the other layer as adjacent thereto.

Here in accordance with the present invention, it becomes able to apply an alloy of copper, such as a system of Cu—Sn or the like, in addition to copper as preferred to the intermediate layer (3). And then it is desirable for a concentration of Cu in the alloy of copper to be as not lower than fifty mass percent in the case thereof.

Here in accordance with the layered body by plating (6) to be made use for the present invention, it is desirable for a volume ratio of between the volume of the S-layer (4*a*) and that of the C-layer (3*a*) that is defined as (S/C) to be as not higher than 1.85 in a case where the S-layer (4*a*) is comprised of Sn and where the C-layer (3*a*) is comprised of Cu. Moreover, it is desirable for a thickness of the S-layer (4*a*) to be as not thicker than 9.5 μm.

Further, it is able to form the N-layer (2*a*) that is comprised of Ni or the like, the C-layer (3*a*) that is comprised of Cu or the like, the S-layer (4*a*) that is comprised of Sn or the like, in the layered body by plating (6) by making use of a method of a physical vapor deposition (PVD) or the like. It is preferable to be formed by a method of wet plating because it is convenient to perform and it gains a manufacturing cost as lower as well.

Here in accordance with the present invention, there is given an example for an intermetallic compound of Cu—Sn in order to form the alloy layer of Cu—Sn (4), such as $Cu_6Sn_5$, $Cu_3Sn$, $Cu_4Sn$, or the like. $Cu_6Sn_5$ is generated by being reacted Sn as a volume of 1.90 with corresponding to a volume as one for Cu. $Cu_3Sn$ is generated by being reacted Sn as the volume of 0.76 with corresponding to the volume as one for Cu on the contrary thereto. $Cu_4Sn$ is generated by being reacted Sn as the volume of 0.57 with corresponding to the volume as one for Cu on the contrary thereto.

Therefore, there becomes to be formed an alloy layer of Cu—Sn in which $Cu_6Sn_5$ is dominant in a case of performing a process of treating with heat for a layered body by plating with an amount of time for longer, that has the volume ratio of between the volume of the S-layer (4*a*) and that of the C-layer (3*a*) as the (S/C) to be as between 1.90 and 1.80 for instance. While, there becomes to be formed another alloy layer of Cu—Sn in which $Cu_3Sn$ is dominant in a case of performing the process of treating with heat for another layered body by plating with an amount of time for longer, that has the ratio of volumes of therebetween to be as between 0.76 and 0.70 on the contrary thereto for instance. While, there becomes to be formed another alloy layer of Cu—Sn in which $Cu_4Sn$ is dominant in a case of performing the process of treating with heat for another layered body by plating with an amount of time for longer, that has the ratio of volumes of therebetween to be as between 0.57 and 0.50 on the contrary thereto for instance. Moreover, there may be a case where there becomes to be thinner a thickness of the alloy layer of Cu—Sn, or there may be a case where there becomes to be formed a layer in which there becomes to be existing together $Cu_6Sn_5$, $Cu_3Sn$ and $Cu_4Sn$, due to the reaction thereof as not to be performed completely in a case of performing the process of treating with heat at a temperature as higher and of performing the process of treating with heat with an amount of time for shorter.

Further, in a case of configuring the alloy layer of Cu—Sn (4) by making use of the layers as two of the layer of $Cu_6Sn_5$ and the layer of $Cu_3Sn$ in accordance with the present invention, there is no specification in particular regarding a thickness of each of the layers. Or, it is further preferable for the layer of $Cu_6Sn_5$ to be as between 0.01 μm and 5.0 μm, and it is further preferable for the layer of $Cu_3Sn$ to be as between 0.008 μm and 4.0 μm as well.

Still further, regarding the metallic material for the connector (5) in accordance with the present invention, there becomes not to be affected negatively onto the performance thereof even in a case where there is formed an oxide film layer which has a thickness of not thicker than 100 nm onto the surface of the alloy layer of Cu—Sn (4). Here regarding the metallic material for the connector (5) in accordance with the present invention, there is designed for the outermost layer (4*a*) before performing the process of treating with heat to be as Sn or the alloy of Sn, and then thereby there becomes to be formed an oxide of Sn as an oxidized substance in the case thereof. And then the oxide of Sn has an electrical conductivity as higher comparing to that of an oxide of Cu or the like. And hence it may be considered that there becomes not to be affected negatively onto the electrical conductivity thereof as the metallic material. Still further, it is desirable for the thickness of the oxide film layer thereon to be as not thicker than 30 nm.

Still further, it may be available in accordance with the present invention to design a dissimilar material as a different kind to be interjacent at between the electrically conductive substrate (1) and the underlayer (2), and/or at between the underlayer (2) and the intermediate layer (3), and/or at between the intermediate layer (3) and the alloy layer of Cu—Sn (4), that has a thickness as thinner than that of each of the layers to be adjacent thereto.

Still further, it may be available to design the alloy layer of Cu—Sn (4) to be provided onto the electrically conductive substrate (1) regarding the metallic material in accordance with the present invention, and it may be available to design the alloy layer of Cu—Sn (4) to be provided onto the underlayer (2) which is provided on the electrically conductive substrate (1) as well.

Furthermore, it is able to adopt as arbitrarily regarding a shape of the metallic material for the connector in accordance with the present invention, such as a bar material or a plate material or the like, if the material has a shape that forms at least a part of the male terminal in the connector and/or at least a part of the female terminal.

Next, there is provided a connector for another embodiment in accordance with the present invention, in which the metallic material for the connector configures at least a contact member part. And then it is desirable in particular to be as a connector of a multi way type or as a contact shoe. Moreover, it becomes able to work with making use of the metallic material for the connector in accordance with the present invention into such as a connector or a contact shoe or the like for a usage of a motor vehicle or of an electrical device or of an electronic device or the like.

Further, it becomes able to apply the metallic material for the connector in the present invention to either one of a side on a male terminal or a side on a female terminal or both of the sides thereof in a case of applying the material to the male terminal and the female terminal in an electrical component and part. Still further, there is no problem at all to apply the material only to a part that is required.

Still further, it becomes available in accordance with the present invention to provide the connector for an electrical device and for an electronic device, that is comprised of the male terminal and the female terminal, that becomes to be easier for the production thereof, that becomes to have the electrical connectability as further stable, and that there becomes to be improved the properties for inserting and for extracting, and it becomes available to provide the metallic material for a connector as well, that is made use for the connector, and then that becomes to be applied as preferred to the connect member part in the male terminal or in the female terminal or the like.

The connector of the present invention is formed of the metallic material in which there is designed for the outermost surface of at least either one of the male terminal or the female terminal to be as the alloy layer of Cu—Sn. The fretting phenomenon does not easily occur even when the metal layer as the outermost surface is thinner and the contact pressure therebetween is weaker. Therefore, it becomes able to obtain the properties for inserting and for extracting as further excellently and the electrical connectability as further stable regarding the connector in accordance with the present invention. Still further, it becomes able to obtain the advantage as similar thereto in the case where there is designed for the outermost surface of the contact member part of at least either one of the male terminal or the female terminal to be as the alloy layer of Cu—Sn in which there is designed for the concentration of Cu to be decreased as gradually. And then it is able to perform the process of treating with heat with an amount of time for further shorter in a case of producing the material as the gradation like formation with the thickness for plating as similar to that to be produced as the layered formation and with the temperature of the heat treatment as similar thereto. Or, it is able to design the temperature of the heat treatment to be as lower in a case where there is designed for an amount of time for performing the heat treatment to be as similar to therebetween as well. And hence it becomes able to obtain the further advantage that there becomes to be speeded up the production thereof or that there becomes to be reduced the cost of the heat treatment.

Still further, it becomes able to enhance as locally a contact pressure against the other material as the opponent side by forming the hardness of the surface thereof to be as heterogeneous regarding the connector which is characterized in that there is designed for the connector to comprise the male terminal and the female terminal that it is possible to connect to each other, that there is designed for all over the surface of the terminal of either one of the male terminal or the female terminal or at least the contact member part of either one thereof only to be formed of the metallic material in which the outermost surface thereof is the alloy layer of Cu—Sn, and that there is designed for all over the surface of the other terminal against the either one of the male terminal or the female terminal or at least the contact member part of the other terminal against the either one thereof only to be formed of the metallic material in which the outermost surface thereof is the layer of Sn or the alloy layer of Sn. And then thereby it becomes able to ensure an electrical conduction to therebetween as certainly, and it becomes able to suppress the electrical resistance thereof as further lower as well. Still further, in the case where there is designed only for the contact member part thereof to become alloyed as Cu—Sn, it becomes able to suppress an exposure of a basic material, and it becomes able to enhance further the corrosion resistance as comparing to a case where there is designed for all of the parts to become alloyed as a layer of Cu—Sn as well, by designing for such as a part for bending work on the terminal or the like to be remained pure Sn which is further softer. It becomes able to form the connector that has the properties as mentioned above by making use of the metallic material for the connector in accordance with the present invention.

EXAMPLES

Next, the present invention will be described in further detail below, in reference to the following examples. However, each of the samples or the condition of the production or the like is just a specific example, and then thereby the present invention will not be limited to any one of the examples.

Example 1

First of all there is performed the following process of removing a grease from a bar material of an alloy of copper (brass) which has a thickness as 0.25 mm, and then thereafter there is performed a process of acid cleaning thereof. Moreover, there is performed thereafter a production of a layered body by plating by performing a process of an electroplating of Ni and then Cu and then Sn as a layered formation in such order onto the bar material of the alloy of copper under the following individual conditions as shown in Table 1. The individual conditions for plating each of the metals are shown in Table 1.

TABLE 1

| PLATING METAL | COMPOSITION OF PLATING BATH CONSTITUENT | CONCENTRATION (g/l) | BATH TEMPERATURE (° C.) | ELECTRIC CURRENT DENSITY (A/dm$^2$) |
|---|---|---|---|---|
| Ni | NICKEL SULFAMATE | 500 | 60 | 5 |
| | BORIC ACID | 30 | | |
| Cu | COPPER SULFATE | 180 | 40 | 5 |
| | SULFURIC ACID | 80 | | |
| Sn | THE 524M SOLUTION PRODUCED BY Ishihara Chemical Co., Ltd. | — | 30 | 5 |

Here there is designed for the volume ratio of between the volume of the S-layer and that of the C-layer as the (S/C) to be varied in a variety thereof regarding the layered body by plating to be produced thereby. And then thereafter there is performed a process of treating with heat for the layered body by plating, and hence there is produced the following individual samples of the metallic material as the sample numbers of 1 to 3 that individually have the configurations as shown in FIG. 4 and FIG. 6 through FIG. 17 respectively. Here FIG. 4 corresponds to the sample number as 1 of the metallic material, meanwhile, all of FIG. 6 through FIG. 10 correspond to the sample number as 2 of the metallic material, meanwhile, all of FIG. 11 through FIG. 17 correspond to the sample number as 3 of the metallic material.

As more specifically, there is performed the production of the individual layered bodies by plating with designing each of the volume ratios of between the volume of the S-layer and that of the C-layer as the (S/C) to be as shown in the following Table 2. And then thereafter there is performed a treatment for the individual layered bodies by plating by making use of a method of treating with heat (a method of batch processing or a method of reflow processing) that is shown in Table 2 as well. Accordingly, the samples of the metallic material are produced as the sample numbers of 1 to 3. CONDITION OF HEAT TREATMENT in Table 2 shows a temperature inside a furnace for a treatment in a batch processing, and a temperature inside a reflow furnace for a heat treatment in a reflow processing. The temperature inside the reflow furnace is fixed at approximately 740° C. shown in Table 2.

Further, regarding each of the metallic materials to be obtained thereby, first of all there is performed for each of the samples with the oblique section of thirty degrees by making use of the focused ion beam (FIB) with setting the same to be inclined as sixty degrees, and each of the samples is assumed to be as the sample for the Auger analysis and measurement (AES). Still further, there is performed the analysis of the AES with each of the samples to be inclined for having the oblique section of thirty degrees to become horizontal. And hence there becomes to be obtained each of the individual electron images of the AES, and then by making thereof there is measured a thickness of each of the layers thereon. Furthermore, there is shown a configuration of each of the samples in the following Table 2.

TABLE 2

| SAMPLE NUMBER | VOLUME RATIO OF LAYERED BODY BY PLATING: S-LAYER/C-LAYER | CONDITION OF HEAT TREATMENT | CONFIGURATION OF PLATING MATERIAL (μm) UNDERLAYER | INTERMEDIATE LAYER | OUTERMOST LAYER |
|---|---|---|---|---|---|
| 1 | 1.85 | 160° C. × 120 hr | Ni 0.4 | Cu 0.02 | Cu—Sn 2.0 |
| 2 | 1.00 | 740° C. × 7 sec | Ni 0.4 | Cu 0.05 | Cu—Sn 0.35 |
| 3 | 0.63 | 740° C. × 7 sec | Ni 0.4 | Cu 0.36 | Cu—Sn 0.45 |

Next, there is performed a test for slight sliding regarding each of the obtained samples as the sample numbers of 1 to 3 till the number of times for going and coming back of the slight sliding reaching to 1000 times, that will be described below. And then there is performed a measurement as continuously regarding a variation of a value of the contact resistance of therebetween. Moreover, there is performed the test for slight sliding thereof as the following description.

Figure 18:
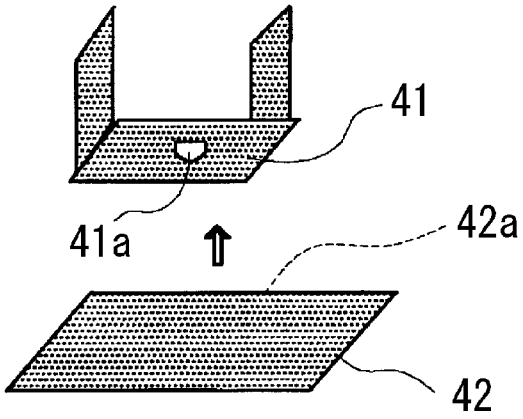
FIG. 18 is an explanatory drawing from a diagrammatic perspective view showing a method for testing a slight sliding.

That is, there is prepared the metallic materials as one pair of (41) and (42) as shown in FIG. 18, that there is provided a projected part of hemispheric shape (41*a*) which has a radius of curvature as 1.8 mm with being performed a reflow plating of Sn for an outside surface of the projected convex part to have a thickness of approximately 1 μm on the metallic material (41), and that the metallic material (42) comprises an alloy layer of Cu—Sn (42*a*). Moreover, there is performed a process of cleaning for removing any grease from both of the materials, and then thereafter there is contacted to therebetween with a contact pressure of 3 N. Further, there is performed a sliding for going and coming back the both of the materials with a distance for sliding as 30 μm under an environment at a temperature of 20° C. and with a humidity of 65% approximately. Further, there is flowed a constant electrical current as 5 mA with applying an open circuit voltage as 20 mV to between the metallic materials (41) and (42). Still further, there is measured a fall of voltage at the period of sliding therebetween by making use of a four terminal method, and then there is evaluated the variation of the electrical resistance thereof for every one second. Here there is shown a value of the contact resistance before performing the test for slight sliding (an initial value) and a maximum value of the contact resistance at the period of performing the test for slight sliding (a maximum value) in the following Table 3. Still further, there is performed the movement of going and coming back with a frequency of approximately 3.3 Hz. Still further, there is measured a coefficient of dynamic friction for each thereof by making use of a friction tester of the Bowden type under the following conditions of the load as 2.94 N, the distance of sliding as 10 mm, the velocity of sliding as 100 mm/min and the number of times for sliding as one time. Still further, there is made use of a partner material on which there is performed a work for forming a projected part to have a curvature of 0.5 mm R after performing a reflow plating of Sn with a thickness of approximately 1 μm onto a bar material of brass which has a plate thickness of 0.25 mm approximately. Furthermore, there is shown both in Table 3 regarding each of the results from the individual measurements for each of the coefficient of friction.

TABLE 3

| SAMPLE NUMBER | CONTACT RESISTANCE INITIAL VALUE | MAXIMUM VALUE OF SLIDING | COEFFICIENT OF FRICTION |
|---|---|---|---|
| 1 | GOOD | GOOD | 0.18 |
| 2 | GOOD | GOOD | 0.19 |
| 3 | GOOD | GOOD | 0.24 |

(INITIAL VALUE: GOOD ≦ 3 mΩ, NO GOOD > 3 mΩ)
(MAXIMUM VALUE OF SLIDING: GOOD ≦ 10 mΩ, NO GOOD > 10 mΩ)

Example 2

Here there is performed a production of a layered body by performing the process of the electroplating of Ni and then Cu and then Sn as the layered formation in such order onto each of the substrates of the alloy of copper as similar to that in accordance with the above Example 1, that comprises each of the plating layers which individually have the thicknesses as shown in the following Table 4. Moreover, there is performed a production of a connector that is comprised of the individual male terminals in accordance with the following Comparative example 1 and the following Present invention example 1 to 4, and the individual female terminals that individually are connectable with the corresponding male terminals respectively, with making use of each of the materials which is performed the process of the reflow treatment under the conditions of treating with heat as shown in the above Table 1 (the temperature thereof and the amount of time), and that are shown in FIG. 1 and in FIG. 2. Further, there becomes for the surface of the female terminal in accordance with Present invention example 1 and for the surface of the male terminal in accordance with Present invention example 3 to be formed as the alloy of Cu—Sn individually for all over the individual surfaces thereof as shown in FIG. 6 through FIG. 10 by making use of the process of reflow treatment. Furthermore, there becomes for the surface of the female terminal in accordance with Present invention example 2 and for the surface of the male terminal in accordance with Present invention example 4 to be formed with Sn being diffused partially into each of the alloy layers of Cu—Sn individually as shown in FIG. 11 through FIG. 15 by making use of the process on the contrary thereto.

TABLE 4

| | COMPARATIVE EXAMPLE 1 | | PRESENT INVENTION EXAMPLE 1 | | PRESENT INVENTION EXAMPLE 2 | | PRESENT INVENTION EXAMPLE 3 | | PRESENT INVENTION EXAMPLE 4 | |
|---|---|---|---|---|---|---|---|---|---|---|
| | MALE Cu ALLOY | FEMALE Cu ALLOY | MALE Cu ALLOY | FEMALE Cu ALLOY | MALE Cu ALLOY | FEMALE Cu ALLOY | MALE Cu ALLOY | FEMALE Cu ALLOY | MALE Cu ALLOY | FEMALE Cu ALLOY |
| PURE Sn LAYER | 0.8 | 0.8 | 0.8 | 0.3 | 0.8 | 0.5 | 0.3 | 0.8 | 0.5 | 0.8 |
| Cu LAYER | 0.3 | 0.3 | 0.3 | 0.3 | 0.3 | 0.8 | 0.3 | 0.3 | 0.8 | 0.3 |
| Ni LAYER | 0.5 | 0.5 | 0.5 | 0.5 | 0.5 | 0.5 | 0.5 | 0.5 | 0.5 | 0.5 |
| BASE SUBSTANCE | COPPER ALLOY | COPPER ALLOY | COPPER ALLOY | COPPER ALLOY | COPPER ALLOY | COPPER ALLOY | COPPER ALLOY | COPPER ALLOY | COPPER ALLOY | COPPER ALLOY |
| HEAT TREATMENT TEMPERATURE (° C.) TIME (×) RETENTION TIME (S) | 740° C. × 7 sec | 740° C. × 7 sec | 740° C. × 7 sec | 740° C. × 7 sec | 740° C. × 7 sec | 740° C. × 7 sec | 740° C. × 7 sec | 740° C. × 7 sec | 740° C. × 7 sec | 740° C. × 7 sec |

Figure 19:
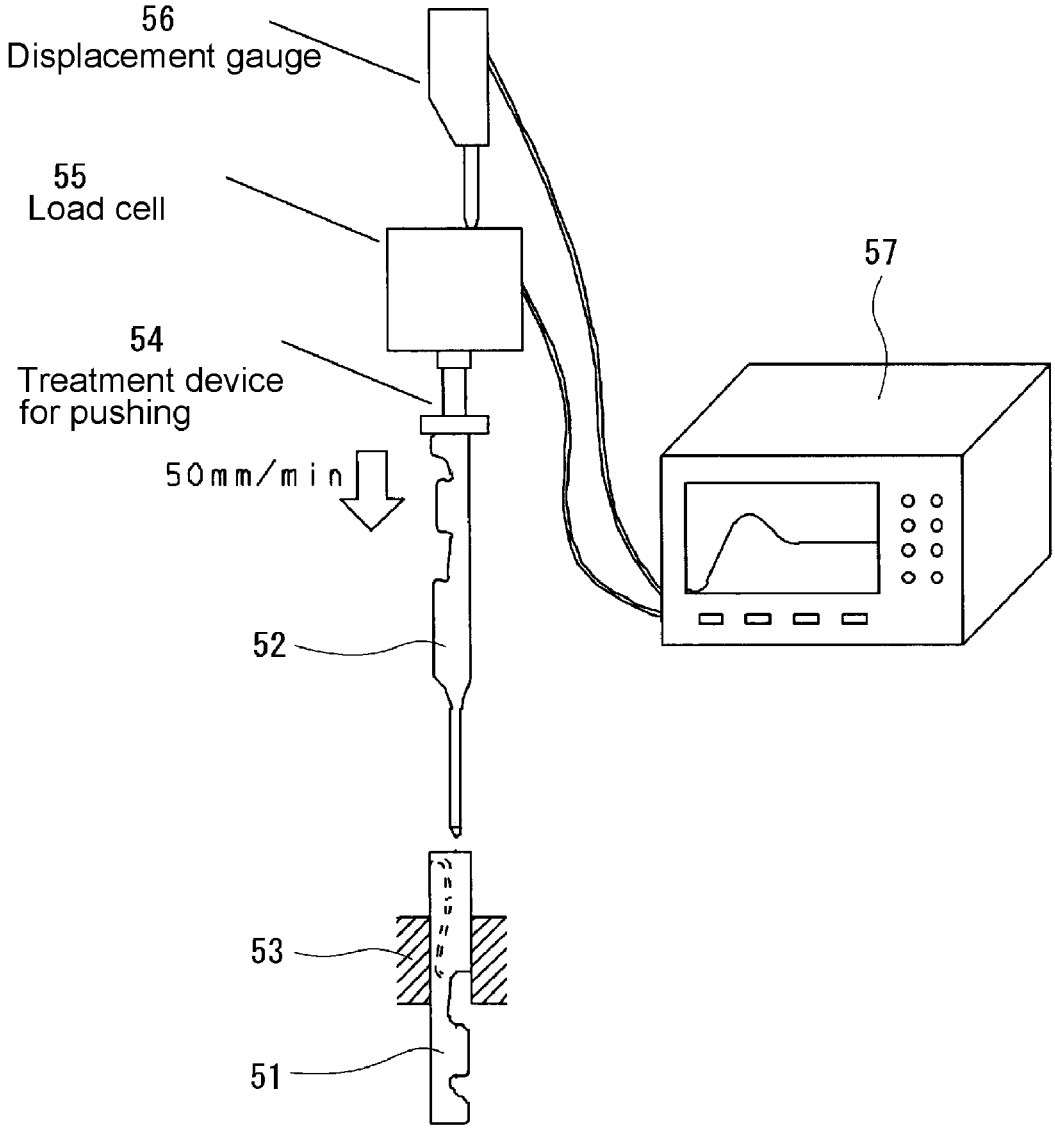
FIG. 19 is an explanatory drawing showing a test of a force for inserting in accordance with Example 2.

Next, there is performed a test of force for insertion by making use of the method in accordance with the explanatory drawing as schematically shown in the drawing from a side view of FIG. 19 with making use of the individual male terminals and the individual female terminals in accordance with the Present invention examples and Comparative example. That is to say, there is fixed a female terminal (51) by making use of a treatment device (53), and then there is inserted a male terminal (52) into a treatment device for pushing (54) with a velocity thereof as 50 mm/min in a direction to an axis thereof (in the direction to the regular insertion of the terminal at the time of the engagement for the connector). Moreover, there is performed a monitoring regarding a curved line of between a displacement thereof and a load thereto at the period thereof by making use of a monitor (57) which is connected to a load cell (55) and to a displacement gauge (56). And then there is recorded a peak value of loading for the terminal at a period till reaching to the regular position of the engagement thereof to be assumed as a force for inserting the single terminal. Further, there is shown the monitor (57) with making use of the drawing from a diagrammatic perspective view in order to understand as easier. Still further, there is performed the measurements with the number of times as five times for each of the sample terminals, and then there is performed an calculation for evaluating an average value thereof. Furthermore, there is shown each of the results thereof in the following Table 5.

TABLE 5

| | N |
|---|---|
| COMPARATIVE EXAMPLE 1 | 2.58 |
| PRESENT INVENTION EXAMPLE 1 | 2.48 |
| PRESENT INVENTION EXAMPLE 2 | 2.32 |
| PRESENT INVENTION EXAMPLE 3 | 2.26 |
| PRESENT INVENTION EXAMPLE 4 | 2.22 |

In the connectors in accordance with Present invention example 1 through 4 as shown in Table 5, it becomes able to reduce the force for inserting as not less than 0.1 N as comparing to the connector in accordance with Comparative example 1, and then thereby it becomes able to obtain the property of insertion and of extraction as further excellently.

Figure 20:
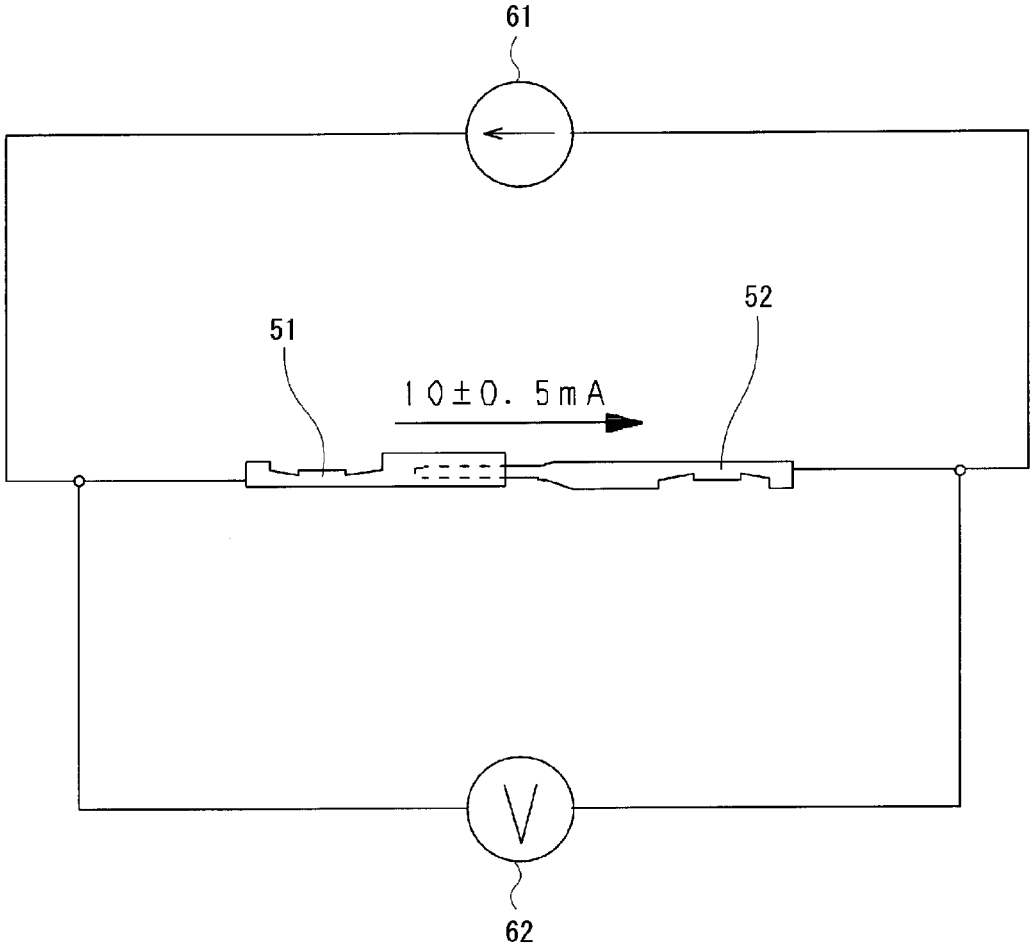
FIG. 20 is a circuit diagram showing a test for measuring a value of resistance in accordance with Example 2.

Next, there is performed an insertion of a terminal which is finished jointing with an electric wire by pressing thereon into a housing of a connector which is provided at each of the female terminal (51) and the male terminal (52). And then thereafter the sample as a state to be engaged with each other is put into a constant temperature bath, and then there is maintained the sample at a temperature of 120±3° C. with an amount of time for 120 hours. And then thereafter the sample is taken out from the constant temperature bath, and then the same is remained till the temperature thereof to be as same as a room temperature. Moreover, there is set thereafter the sample to be as shown in a circuit diagram of FIG. 20, and then there is charged with electricity with making use of an electric power supply (61) under the condition of 20±5 mV at a period of opening the circuit and of 10±0.5 mA at a period of closing the circuit. And then there is performed a measurement of a voltage with making use of a voltmeter (62) at a position as 100 mm from either one of the male or the female terminals. Further, there is performed a calculation to evaluate a value of resistance by making use of the individual values of voltage and the electrical current to be charged with electricity that are measured thereby. Still further, there is performed a calculation to evaluate a value of resistance regarding the terminal part after maintaining at a temperature as higher by subtracting the value of resistance as 6.54 mΩ for the electric wire with the length thereof as 200 mm. Still further, there is shown each of the results in the following Table 6. Still further, there is performed a calculation to evaluate a value of resistance as similar thereto regarding the connector at a state before being put into the constant temperature bath, and then there is performed a calculation to evaluate an initial value of resistance. Still further, there is performed a calculation to evaluate an increased value thereof against the value of resistance after being maintained at the higher temperature as well. And hence there is shown each of the values together in Table 6 as well. Furthermore, a unit for each of the values of resistance in Table 6 is defined here to be as mΩ respectively.

TABLE 6

| | INITIAL STAGE | AFTER MAINTAINING AT HIGH TEMPERATURE | INCREASED VALUE |
|---|---|---|---|
| COMPARATIVE EXAMPLE 1 | 2.12 | 2.72 | 0.60 |
| PRESENT INVENTION EXAMPLE 1 | 2.15 | 2.48 | 0.33 |
| PRESENT INVENTION EXAMPLE 2 | 2.22 | 2.76 | 0.54 |
| PRESENT INVENTION EXAMPLE 3 | 2.29 | 2.58 | 0.29 |
| PRESENT INVENTION EXAMPLE 4 | 2.19 | 2.52 | 0.33 |

Here regarding the connectors in accordance with Present invention examples 1 through 4, it is found out as shown in Table 6 that each of the increased values of the resistance is smaller than that in accordance with Comparative example 1 in spite of the thickness of each of the metal layers as thinner in comparison with the connector in accordance with Comparative example 1, and hence that it becomes able to obtain the electrical connectability therebetween as further excellently and further stably for the connector.

INDUSTRIAL APPLICABILITY

Here it becomes able to apply the connector in accordance with the present invention as preferred to a connector to be made use for such as a motor vehicle, for an electrical device and for an electronic device, for an electrical component and an electronic component, or the like.

Moreover, it becomes able to apply the metallic material for the connector in accordance with the present invention as preferred to a material to be made use for such as a contact member part of a male terminal or of a female terminal, for the connectors as a variety types thereof that are mentioned above, for a contact shoe, or the like.

Thus, there is described as above regarding the present invention in reference to the embodiment, however, the present invention will not be limited to every detail of the description as far as a particular designation, and it should be interpreted widely without departing from the spirit and scope of the present invention as disclosed in the attached claims.

Furthermore, the present invention claims the priority based on Japanese Patent Application No. 2007-102099, that is patent applied in Japan on the ninth day of April 2007, and the entire contents of which are expressly incorporated herein by reference.

What is claimed is:

1. A connector, comprising:

a male connector including a male terminal; and a female connector including a female terminal and arranged to be connectable with the male connector, wherein said male terminal is composed of a metallic material, and wherein said metallic material comprises:

an electrically conductive substrate, a metal layer composed of Ni, an alloy of Ni, Fe, an alloy of Fe, Co, or an alloy of Co, an intermediate layer comprised of Cu, and an outermost surface layer, in this order from the substrate; and the outermost surface layer has a contact area composed of an alloy layer of Cu—Sn, wherein said alloy layer of Cu—Sn includes Sn or an alloy of Sn diffused therein, and at least a part of Sn or the alloy of Sn is exposed on a surface of the alloy layer of Cu—Sn, with Sn or said alloy of Sn being diffused in an island shape or a punctuate shape in a cross sectional view, and wherein said female terminal is composed of a metallic material having a contact area with an outermost surface layer composed of a layer of Sn or an alloy layer of Sn.

2. The connector according to claim 1, wherein said outermost surface layer is entirely composed of the alloy layer of Cu—Sn.

3. The connector according to claim 1, wherein said outermost surface of the metallic material of Cu—Sn at an area other than the contact area is composed of a layer of Sn or an alloy layer of Sn.

* * * * *